US006176031B1

(12) United States Patent
Ramsey

(10) Patent No.: US 6,176,031 B1
(45) Date of Patent: Jan. 23, 2001

(54) SELF ALIGNING TOOL FOR INSERTING PERCUSSION CAPS ON FIRING NIPPLES

(76) Inventor: Del Ramsey, Rte. 6 Box 384, Harrison, AR (US) 72601

( * ) Notice: Under 35 U.S.C. 154(b), the term of this patent shall be extended for 0 days.

(21) Appl. No.: 09/276,408

(22) Filed: Mar. 25, 1999

Related U.S. Application Data

(60) Provisional application No. 60/079,263, filed on Mar. 25, 1998.

(51) Int. Cl.[7] ..... F41A 9/00

(52) U.S. Cl. ..... 42/90; 42/83

(58) Field of Search ..... 42/90, 51, 83, 42/1.01, 1.05, 70.11, 70.01; 89/1.3

(56) References Cited

U.S. PATENT DOCUMENTS

| | | | | |
|---|---|---|---|---|
| 1,482,150 | * | 1/1924 | Rice | 42/70.01 |
| 3,193,959 | * | 7/1965 | Jaycox | 42/70.11 |
| 4,205,475 | * | 6/1980 | Wilson | 42/90 |
| 4,334,376 | * | 6/1982 | Winslow | 42/90 |
| 4,835,894 | * | 6/1989 | Libassi | 42/70.11 |
| 5,487,232 | * | 1/1996 | Osborne et al. | 42/51 |
| 5,596,167 | | 1/1997 | Davis | 102/532 |
| 5,806,227 | * | 9/1998 | Yoder | 42/90 |

FOREIGN PATENT DOCUMENTS

| | | | | |
|---|---|---|---|---|
| 12435 | * | 10/1885 | (GB) | 42/90 |

* cited by examiner

*Primary Examiner*—Michael J. Carone
*Assistant Examiner*—Son T. Nguyen
(74) *Attorney, Agent, or Firm*—Head, Johnson & Kachgian

(57) ABSTRACT

A self-aligning tool for inserting percussion caps on firing nipples comprising a central hub with radially spaced apart spokes that each form an integral arm that terminates in a distal hand for temporarily securing the percussion cap until insertion. Each elongated arm comprises at least one storage hole for storing additional percussion caps. Each distal hand comprises at least one holder for temporarily receiving and retaining the percussion cap. Each holder defines a circular hole into which the cap is inserted for retention. Each holder comprises a periphery defining arcuate outer and inner lips separated by an elongated lateral slot. During the insertion process, the user aligns the percussion cap with the nipple by inserting the arcuate holder lips into the exposed breech. When the lips abut the interior walls of the bore, the cap is also aligned with the nipple. The user then presses the percussion cap firmly against the nipple until it is seated. Once seated, the percussion cap may be removed from the tool holder by a simple twisting action about the central hub. The cap remains seated on the nipple as a result of the friction generated upon the cap sidewalls by the twisting action. The lateral slot permits the cap to easily slide from the holder during the twisting action.

16 Claims, 4 Drawing Sheets

110
120
124
122
126
121
134
130
139
132
136
106
102
100
104
15
30
40
42
44
70
72
74
76
79
50
61
64
60
62
66
46
71
180
181
182
184
186
170
199
194
192
190
196
166
162
164

SELF ALIGNING TOOL FOR INSERTING PERCUSSION CAPS ON FIRING NIPPLES

CROSS REFERENCE TO RELATED APPLICATION

This application is Provisional of U.S. patent application serial No. 60/079,263 entitled Self-Aligning Tool for Inserting Percussion Caps on Firing Nipples filed on Mar. 25, 1998.

BACKGROUND OF THE INVENTION

1. Field of the Invention

The present invention relates generally to muzzleloading or black powder rifle accessories. In particular, the present invention relates to a tool for quickly aligning and inserting a percussion cap on the firing nipple of an in-line muzzleloader.

2. Known Art

As will be appreciated by those skilled in the art, firearms have been well known for literally centuries. For example, prior to the introduction of today's modern firearms, guns known as "black powder" and "muzzleloaders" were commonplace. Such guns often employed ammunition loaded in two stages. In the first stage, the ammunition, including the gunpowder, patches and actual projectile, would be inserted through the muzzle of the firearm where it was packed appropriately. On flintlock weapons, powder would be placed in the "flash pan" struck by the hammer while percussion cap firearms used a cap placed on the firing "nipple". In both cases, the hammer would strike and ignite a powder charge to subsequently fire the projectile.

As can be readily appreciated, percussion cap firearms were a great improvement over flintlocks for a number of reasons, including convenience, dependability, simplicity of use, etc. However, inserting the percussion cap on the firing nipple was often a difficult task for the user.

Often the nipples on percussion cap firearms are very small and wholly contained within the gun breech. Such guns also employ correspondingly small percussion caps. Small percussion caps are often difficult to handle, especially in cold weather when the user's hands may be bundled in gloves or mittens. Consequently, several devices have been proposed to alleviate the problem of handling percussion caps and placing them on nipples.

For example, some prior art devices serve as elongated holders that permit the user to place a single percussion cap on the firing nipple. These devices typically require the user to refill the tool with another cap before subsequent use. This devices requires the user to closely monitor the insertion of the cap on the nipple. As such, it is inoperable for quick second shots because of the excited or nervous condition of the user during quick second shot situations.

A closely related device enables the user to insert multiple caps without refilling the tool. These devices comprise an elongated tube capable of storing multiple caps in the tube itself. They generally employ a push spring to force caps to the tool end. Another prior art device comprises a circular holder with multiple cap holders equidistantly spaced along its periphery. Both of these devices fail to provide an easily aligned capping tool or a capping tool that accommodates both popular sizes of percussion caps.

Thus, the known prior art fails to provide an efficient method for easily aligning and inserting percussion caps quickly and efficiently on a firing nipple. For example, the known prior art fails to provide a combination capping tool that permits the user to use the various types of percussion caps that are commonly available. The known prior art also fails to provide a method for easily aligning the cap with the nipple during insertion.

Furthermore, the known prior art fails to provide capping tools that are ambidextrous. The known prior art discussed hereinabove is only designed for right handed usage. That is, these tools fail to permit a user to utilize the cap with either their right or left hand.

A desirable improvement would be to provide a capping tool that would enable the user to easily align a percussion cap with a firing nipple. Another desirable improvement would be to provide a capping tool that could be employed with either the right or the left hand of the user. Yet another desirable contribution would be an improvement in which the capping tool would automatically align the cap with the nipple during insertion. Such an improvement would facilitate quick second shots regardless of the user's ability to see the firing nipple. Another improvement would be a capping tool that worked well with nipples of different sizes. A capping tool that held multiple caps to facilitate rapid reloading would also be desirable.

SUMMARY OF THE INVENTION

My invention overcomes the above perceived problems associated with the known prior art. The invention comprises a self-aligning tool that may be employed ambidextrously by a user to insert a percussion cap on to the firing nipple of a conventional muzzleloading firearm.

The present invention is adapted to accommodate all commonly available percussion caps. The invention comprises a tool with a central body or hub that has regularly spaced apart spokes emanating from the outer periphery of the hub. Preferably, the central hub defines three radially spaced apart integral spokes protruding outwardly therefrom. Each spoke forms an integral arm that terminates in a distal hand that temporarily secures the percussion cap during the insertion process.

Each elongated arm further comprises a plurality of storage orifices or holes penetrating the spoke body at regular intervals. These storage orifices provide means for storing additional percussion caps upon the tool itself.

As previously mentioned, each distal hand comprises at least one holding cup for temporarily receiving and securing the percussion cap. Since commercially available percussion caps generally are available in two standard sizes, it is preferable to employ two cups, one for each size. Thus, preferably at least two such cups protrude on opposite sides of each hand. Each cup comprises a circular hole bisected by an elongated slot. In the preferred embodiment, the slot also laterally bisects the longitudinal axis of the respective spoke. The lateral slot facilitates percussion cap removal from the cup during installation on the nipple, as will be more fully discussed hereinafter. One of the holes may optionally employ a reinforcing base to support the cap during retention therein.

Preferably, the outer cap perimeter adjacent the lateral slot is arcuately formed so that the cup may be easily aligned inside the gun bore. In other words, the interior lip and exterior lip abutting the slots have arcuate outer perimeters. This is particularly advantageous since most muzzleloading gun breeches are of the same approximate diameter even though the actual diameters of the barrel bore vary between differing calibers of guns (i.e., 0.45 caliber, 0.50 caliber, etc.).

Preferably the tool is manufactured from high density polyethylene or a similar thermoplastic or other plastic-like material that may be easily molded and that is subsequently semi-rigid. It is desirable that the percussion cap slip from the holding cup upon the application of a sufficient twisting motion by the user. Consequently, a slippery, plastic type is preferred. Of course, other suitable materials known to the art could be substituted for high density polyethylene so long as these desirable characteristics are maintained.

The user may employ the tool to easily mount a percussion cap on a conventional nipple in the breech of a muzzleloader. The user first inserts a percussion cap into the appropriate cup upon the tool spoke. Ideally, the user may fill all of the spaced apart spokes with the chosen percussion caps prior to initiating a hunt. Consequently, the user will be able to rapidly insert several caps when reloading his muzzleloader for firing.

During the insertion process, the user aligns the percussion cap with the nipple by inserting the arcuate cup lips into the exposed breech. It is an important feature of the present invention that the arcuate cup lips permit the tool to automatically align the percussion cap with the nipple. Once aligned, the user presses the percussion cap firmly on to the nipple. Once seated, the percussion cap may be removed from the tool cup by a simple twisting action. The cap remains seated on the nipple as a result of the friction generated upon the cap sidewalls by the twisting action. The lateral slot permits the cap to easily slide from the cup during the twisting action.

An object of the present invention is to provide a percussion cap tool that automatically aligns the cap with the muzzleloader nipple.

Another object of the present invention is to permit a hunter or shooter employing a muzzleloader to reload quickly.

A basic object of the present invention is to provide a tool that increases the efficiency of a hunter or shooter.

Another object of the present invention is to provide a tool for inserting percussion caps quickly and efficiently. Another object of the present invention is to provide a tool that may be ambidextrously deployed by a hunter or shooter.

DETAILED DESCRIPTION OF THE PREFERRED EMBODIMENTS

Figure 1:
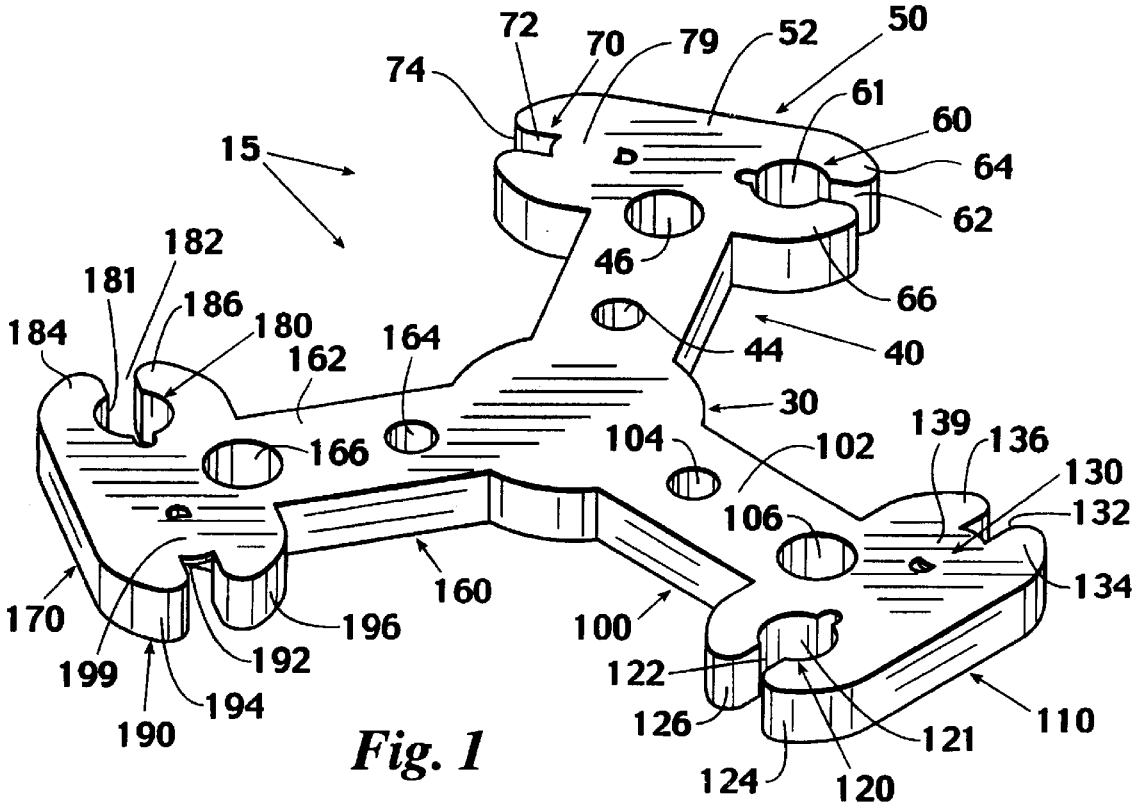
FIG. 1 is a perspective view of my self-aligning capping tool for use with percussion caps.
Figure 5:
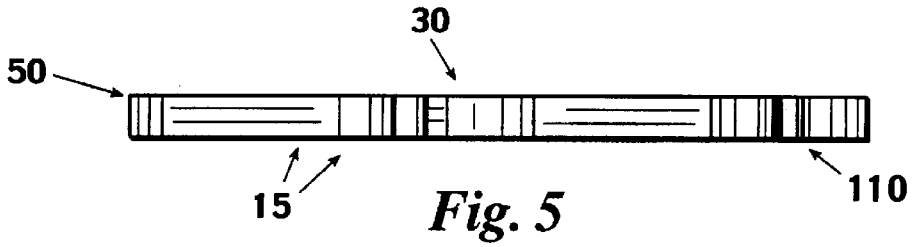
FIG. 5 is a right side elevational view thereof.
Figure 6:
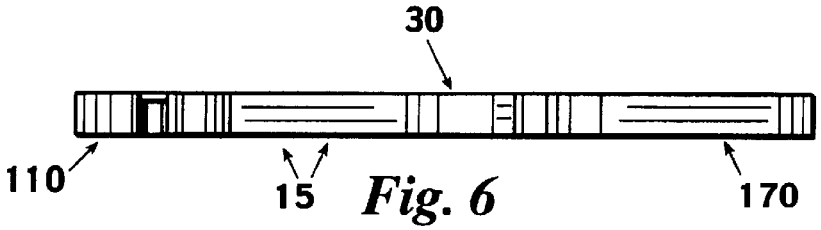
FIG. 6 is a left side elevational view thereof.
Figure 7:
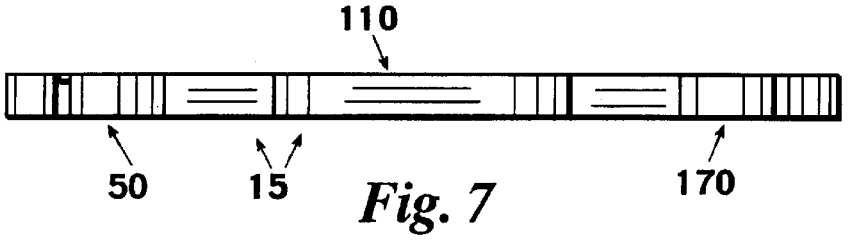
FIG. 7 is a rear elevational view thereof.
Figures 2, 3, 4:
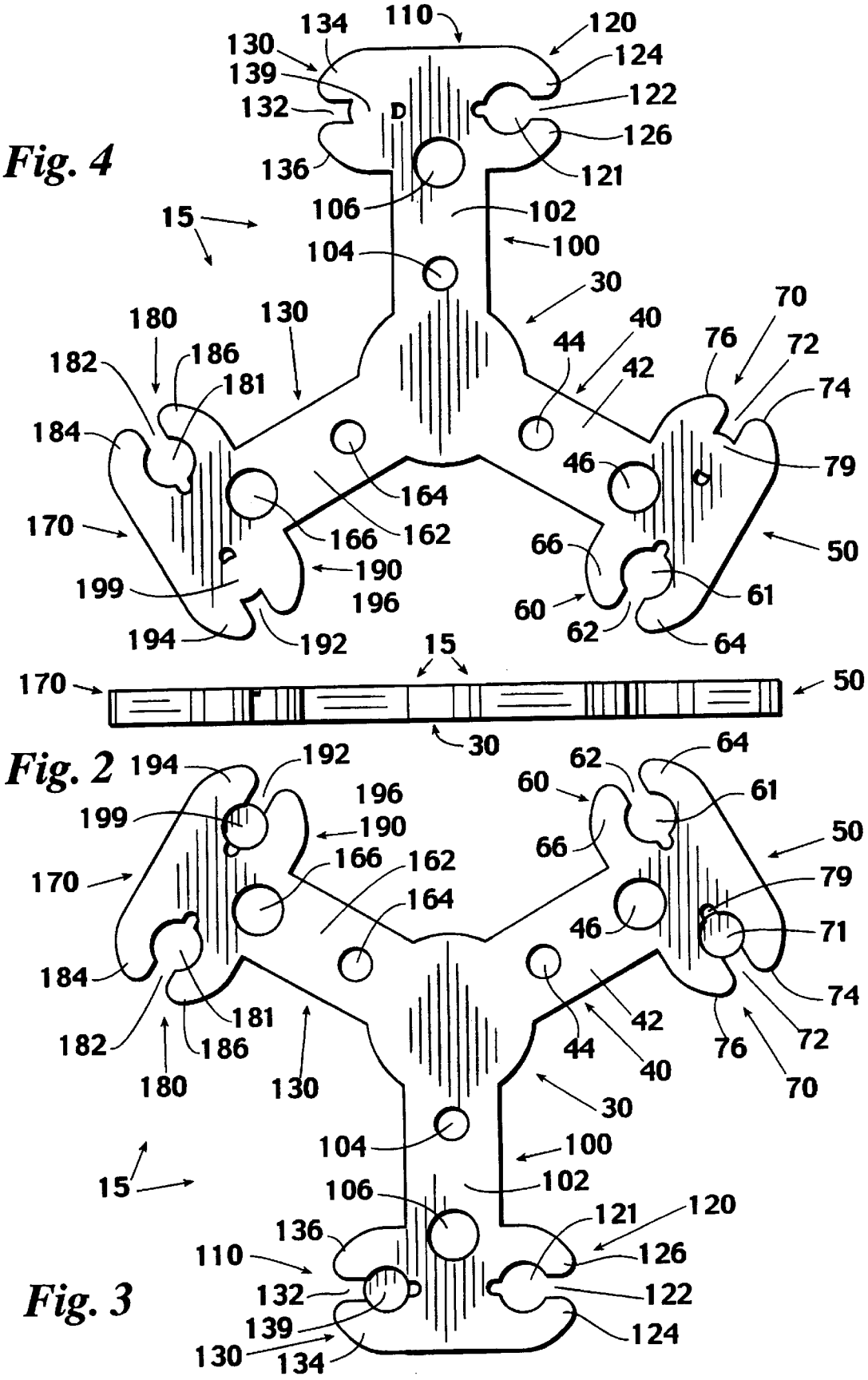
FIG. 2 is a front elevational view thereof.
FIG. 3 is a top plan view thereof.
FIG. 4 is a bottom plan view thereof.

My improved self-aligning capping tool is generally designated by the reference numeral 15 in FIGS. 1–9. The tool 15 permits rapid and efficient insertion of a conventional percussion cap 20 onto the firing nipple 26 of a muzzleloader 25. Conventional percussion cap 20 is a common muzzleloading accessory that is commercially available in two sizes (FIG. 8. The smaller cap 21 has a diameter of approximately 0.125 inches (40 mm) while the larger cap 23 has a diameter of approximately 0.25 inches (70 mm). The larger cap 23 also has several radially spaced apart, laterally protruding tabs 23 to facilitate user manipulation. In the preferred embodiment, the tool 15 may be used with either the smaller cap 21 or the larger cap 23. Preferably, tool 15 is injection molded in a unitary piece. Consequently, tool 15 can be efficiently mass produced with minimal effort. The tool 15 is preferably molded from a thermoplastic (such as high density polyethylene or the like) so that is will be somewhat flexible and slippery.

The tool 15 includes a planar central body or hub 30 that is grasped by the user when manipulating the tool 15 (FIG. 1). In one embodiment, the hub 30 is 0.15 inches thick and it has a circular periphery with a diameter of approximately 0.675 inches. Of course, the central hub can be made larger or smaller if desired.

Hub 30 comprises a plurality of radially spaced apart hubs. In one embodiment, the three radially spaced apart spokes 40, 100, and 160, integrally emanate from the hub 30. In one embodiment, each spoke is approximately one and a half inches in overall length, with an inner length of approximately 0.65 inches. While more spokes could be added, three spokes permit the hunter to rapidly insert a percussion cap three times without reloading tool 15. In other words, the hunter is given the opportunity to fire three times before it is necessary to stop firing to reload the tool 15. Moreover, the employment of three spokes arranged at 120° intervals has been found to promote both the self-aligning aspect of the invention as well as percussion cap removal from tool 15 after 20 insertion onto firing nipple 26. Further, given the time requirements for reloading a muzzleloader (typically exceeding 30 seconds), it is believed extremely unlikely a hunter would get more than three shots at a target before an opportunity to reload tool 15 becomes available. Although spokes 40, 100, and 160 are preferably identical such similarity is not necessary so each spoke will be discussed separately for clarity.

Spoke 40 comprises an elongated arm 42 (approximately 0.41 inches wide) penetrated by at least one intermediate storage hole 44. A second storage hole 46 is preferably defined adjacent the first hole 44. These holes (44,46) are used to store additional percussion caps on the capping tool 15. The arm 42 further comprises a terminal hand 50 that holds the percussion cap 22 until it is inserted on the firing nipple 26.

The hand 50 comprises at least one holder 60 for temporarily retaining one size of the standard nipples (i.e., cap 23). Preferably, the hand 50 deploys a spaced apart second holder 70 that is dimensioned to accept the other size nipples (i.e., cap 21). Holder 60 comprises a central hole 61 with an intersecting slot 62 that laterally bisects the longitudinal axis of the spoke 40. Holder 60 further comprises an exterior arcuate lip 64 and an interior arcuate lip 66. The holder 60 receives and retains the cap 23 in hole 61 until insertion on nipple 26. The second holder 70 is preferably similar to holder 60. It comprises a central hole 71 that is also laterally bisected by a slot 72 that defines an exterior lip 74 and an interior lip 76. A backing plate 79 is preferably utilized to insure proper cap seating and alignment.

Spoke 100 is similar to spoke 40. Spoke 100 comprises an elongated arm 102 penetrated by at least one intermediate storage hole 104. A second storage hole 106 is preferably defined adjacent hole 104. These holes (104,106) are used to store additional percussion caps on the capping tool 15. The arm 102 further comprises a terminal hand 110 that holds the percussion cap 22 until it is inserted on the firing nipple 26.

The hand 110 comprises at least one holder 120 for temporarily retaining one size of the standard nipples (i.e., cap 23). Preferably, the hand 120 deploys a spaced apart second holder 130 that is dimensioned to accept the other size of nipples (i.e., cap 21). Holder 120 comprises a central hole 121 with an intersecting slot 122 that laterally bisects the longitudinal axis of the spoke 100. Holder 120 further comprises an exterior arcuate lip 124 and an interior arcuate lip 126. The holder 120 receives and retains the cap 23 in hole 121 until insertion on nipple 26. The second holder 130 is preferably similar to holder 120. It comprises a central hole 131 that is also laterally bisected by a slot 132 that defines an exterior lip 134 and an interior lip 136. A backing plate 139 is preferably utilized to insure proper cap seating and alignment.

Spoke 160 is preferably similar to spokes 40 and 100. Spoke 160 comprises an elongated arm 162 penetrated by at least one intermediate storage hole 164. A second storage hole 166 is preferably defined adjacent hole 164. These holes (164,166) are used to store additional percussion caps on the capping tool 15. The arm 162 further comprises a terminal hand 170 that holds the percussion cap 22 until it is inserted on the firing nipple 26.

The hand 170 comprises at least one holder 180 for temporarily retaining one size of the standard nipple (i.e., cap 23). Preferably, the hand 180 deploys a spaced apart second holder 190 that is dimensioned to accept the other size of nipples (i.e., cap 21). Holder 180 comprises a central hole 181 with an intersecting slot 182 that laterally bisects the longitudinal axis of the spoke 160. Holder 180 further comprises an exterior arcuate lip 184 and an interior arcuate lip 186. The holder 180 receives and retains the cap 23 in hole 181 until an insertion on nipple 26. The second holder 190 is preferably similar to holder 180. It comprises a central hole 191 that is also laterally bisected by a slot 192 that defines an exterior lip 194 and an interior lip 196. A backing plate 199 is preferably utilized to insure proper cap seating and alignment.

While the spokes 40, 100 and 160 need not be identical, it is critical to maintain the overall symmetry of the tool 15 to promote rapid cap insertion during tool use. In other words, the angular spacing of 120° is important in the operation of tool 15.

OPERATION

A hunter or shooter typically employs the tool to rapidly and efficiently insert eh percussion cap 22 on a conventional firing nipple 26 in the breech of muzzleloader 25. The user first inserts a percussion cap into the appropriate holder (i.e., either 60, 70, 120, 130, 180 and 190) upon the tool 15. Ideally, the user may fill all of the spaced apart holders with the chosen percussion caps prior to initiating a hunt. Consequently, the user will be able to rapidly insert several caps when reloading his muzzleloader.

Figure 8:
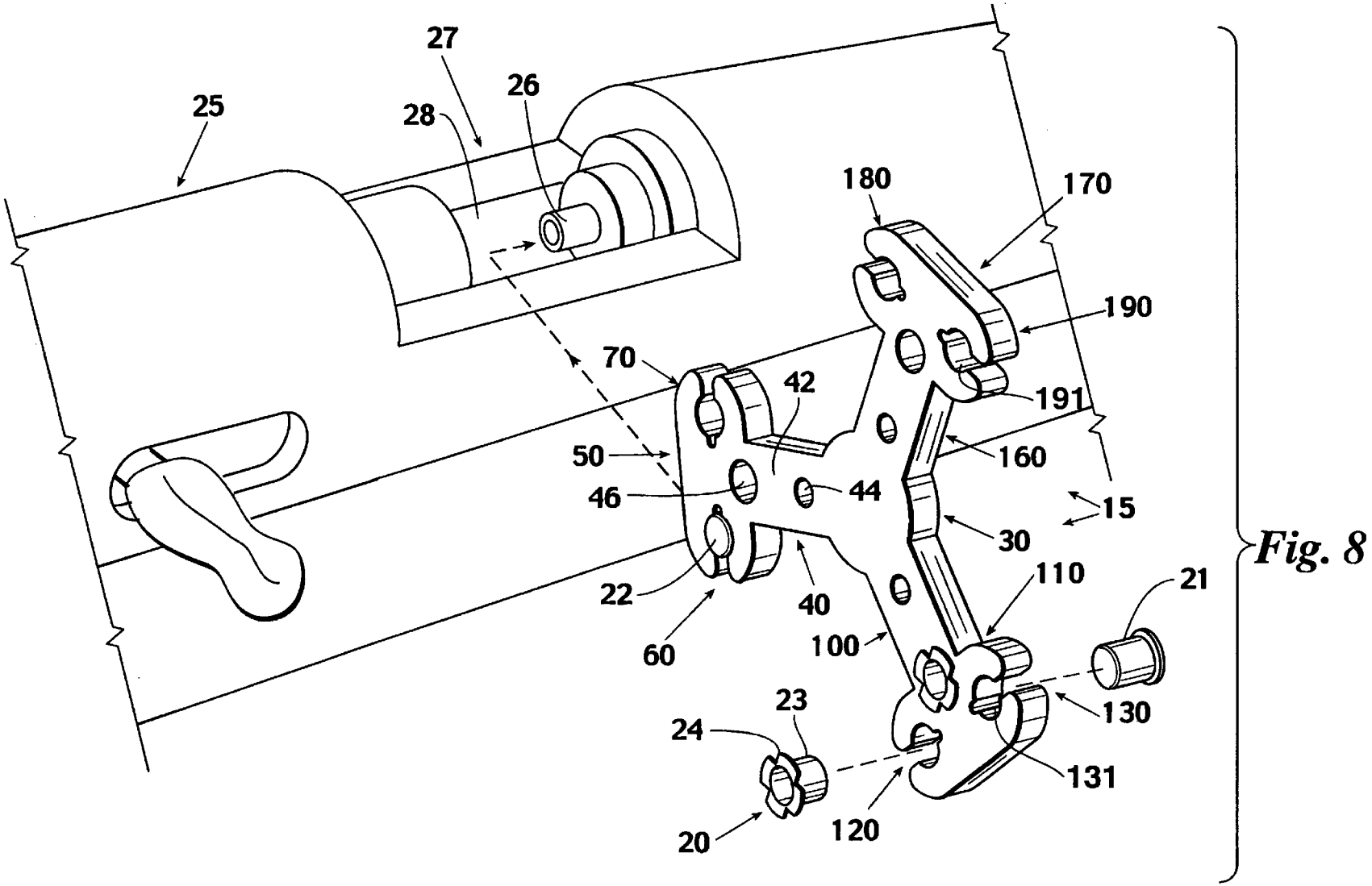
FIG. 8 is a partially exploded environmental view showing the capping tool prior to insertion into the bore of a muzzleloader with two percussion caps slightly enlarged and exploded from their seats.
Figure 9:
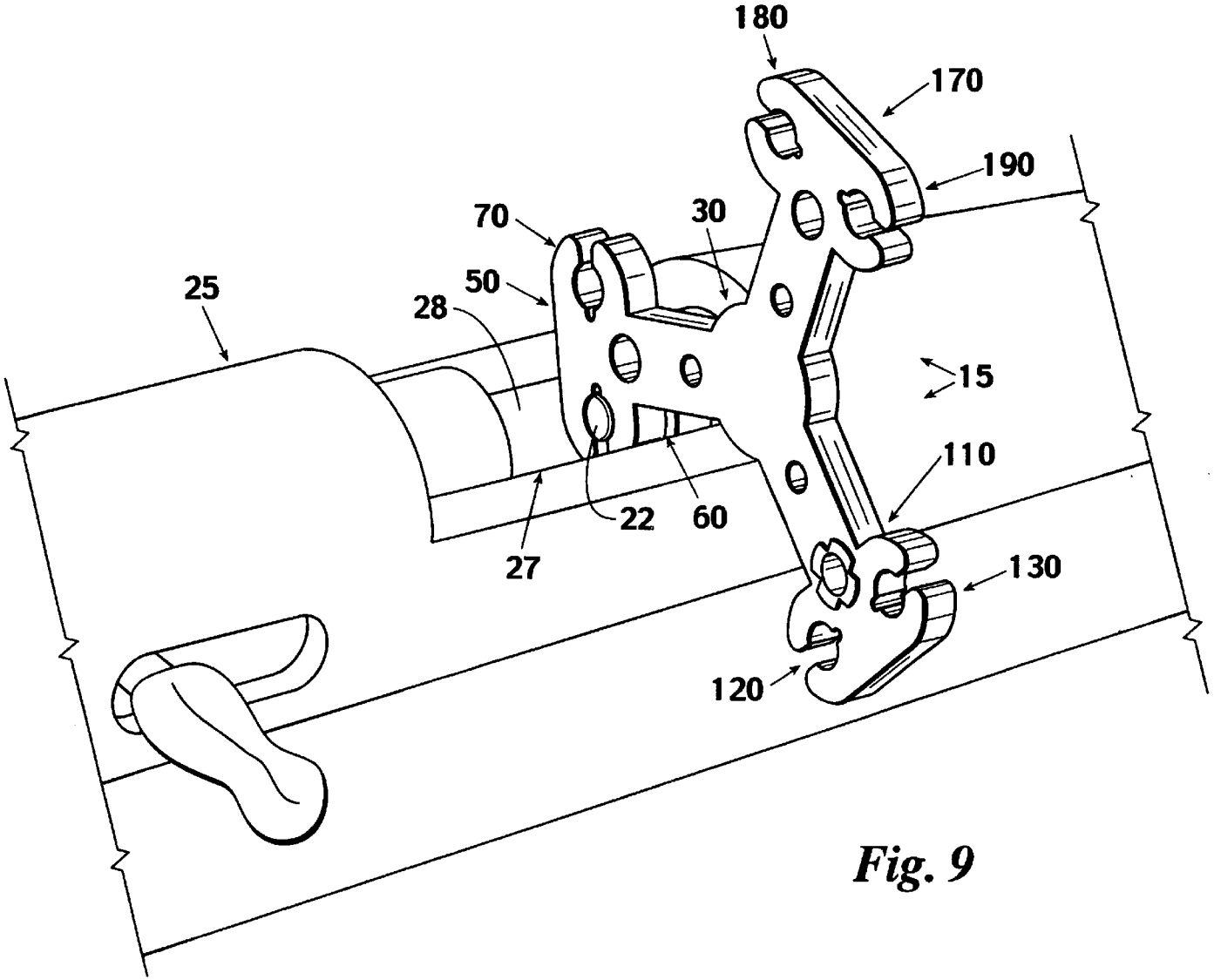
FIG. 9 is an environmental view similar to FIG. 9 but showing the capping tool aligned inside the bore and inserting a cap on the firing nipple of the muzzleloader.

During the insertion process, the user aligns the percussion cap 22 with the nipple 26 by inserting the arcuate holder lips into the exposed breech 27 (FIGS. 8–9). The arcuate holder lips 64, 66, 74, 76, 124, 126, 134, 136, 184, 186, 194 and 196 permit the tool 15 to automatically align the percussion cap 22 with the nipple 26. The user simply inserts the tool 15 into the breech 26 until lips 64, 66, 74, 76, 124, 126, 134, 136, 184, 186, 194 and 196 abut walls 28. When so aligned, the cap 22 is also aligned with nipple 26. The user may then simply push tool 15 forwardly to insert the cap 22 on nipple 26.

Once started, the user presses the percussion cap firmly against the nipple to seat the cap 22. Once seated, the percussion cap may be removed from the tool 15 by twisting action at hub 30. The cap remains seated on the nipple as a result of the friction generated upon the cap sidewalls by the twisting action. The lateral slots 62, 72, 122, 132, 182 and 192 permit the cap 22 to easily slide from the respective holder during this twisting action.

Thus, the self-aligning tool comprises a central hub with integral, radially spaced-apart elongated spokes comprising at least one storage hole for additional percussion caps, each spoke comprising an integral arm with a terminal hand forming at least one holder for retaining a cap until nipple insertion, each holder defining a hole bisected by a lateral slot and having arcuate exterior lips for aligning the holder in a gun breech.

Whereas, the present invention has been described in relation to the drawings attached hereto, it should be understood that other and further modifications, apart from those shown or suggested herein, may be made within the spirit and scope of this invention.

What is claimed is:

1. A ambidextrous self-aligning tool for inserting percussion caps on a firing nipple in a gun breech, said tool comprising:

a central body; and, at least one integral arm extending from said central body with a terminal hand, said hand including a first holder adapted to receive and retain one of said percussion caps until insertion on said nipple and a second holder spaced apart from said first holder, said second holder adapted to receive and retain one of said percussion caps until insertion on said nipple.

2. The tool as recited in claim 1 wherein said tool further comprises second and third arms extending from said central body, each of said arms including an integral arm with a terminal hand including a first holder for a percussion cap.

3. The tool as recited in claim 1 wherein said at least one integral arm further comprises at least one storage hold adapted to temporarily receive and retain an additional cap.

4. A tool for inserting percussion caps on a firing nipple, in a gun breech, said tool comprising:

a central hub;

a plurality of elongated, radially spaced apart spokes extending outwardly from said hub, each of said spokes having at least one storage hole to temporarily receive and retain additional percussion cap; and a terminal hand extending from each of said spokes, each of said hands including a holder adapted to receive and retain a percussion cap.

5. The tool as recited in claim 4 wherein each of said hands defines arcuate exterior lips adapted to align said hand in said breech.

6. The tool as recited in claim 5 wherein said lips are bisected by a lateral slot, said slot permitting said hand to release said cap when said arm is twisted by a user.

7. The tool as recited in claim 6 wherein said lips are adapted to slide on the surface of said gun breech adjacent said nipple when inserting and seating said cap on said nipple.

8. The tool as recited in claim 4 wherein each of said spokes are equidistantly spaced about said hub by 120°.

9. The tool as recited in claim 4 wherein each of said hands further comprises a second holder spacer apart from said first holder, said second holder adapted to receive and retain another of said percussion caps until insertion on said nipple.

10. A tool for inserting an seating percussion caps of varying sizes on a firing nipple in a gun breach, said tool comprising:

a central hub; and a plurality of elongated, radially spaced apart integral arms, each of said arms having a terminal hand, each of said hands including a first holder adapted to receive and retain a percussion cap and a second holder spaced apart from said first holder, said second holder adapted to receive and retain another of said varying sized percussion caps until insertion on said nipple.

11. The tool as recited in claim 10 wherein each of said arms further comprises at least one storage hole adapted to temporarily receive and retain an additional percussion cap.

12. The tool as recited in claim 11 wherein each of said hands defines arcuate exterior lips adapted to align said hand in said breech to enable a user to align said cap with said nipple and wherein said lips are bisected by a lateral slot to permit a user to flex said arm to seat said percussion cap on said nipple.

13. The tool as recited in claim 12 wherein said lips are adapted to slide on the surface of said gun breech adjacent to said nipple when inserting and seating said cap on said nipple.

14. The tool as recited in claim 13 wherein said hub defines a planar surface adapted to be grasped by a user when manipulating said tool and wherein said arms are flexibly attached to said hub to facilitate cap seating on said nipple.

15. The tool as recited in claim 14 wherein said arms are injection molded simultaneously.

16. The tool as recited in claim 15 wherein said arms are radially spaced apart 120°.

* * * * *